US009492869B2

(12) United States Patent
Sun

(10) Patent No.: US 9,492,869 B2
(45) Date of Patent: Nov. 15, 2016

(54) DOUBLE-ALLOY NDFEB RARE EARTH PERMANENT MAGNETIC MATERIAL AND MANUFACTURING METHOD THEREOF

(71) Applicant: China North Magnetic & Electronic Technology Co., LTD, Shenyang, Liaoning (CN)

(72) Inventor: Haotian Sun, Liaoning (CN)

(73) Assignee: China North Magnetic & Electronic Technology Co., LTD, Shenyang, Liaoning (CN)

( * ) Notice: Subject to any disclaimer, the term of this patent is extended or adjusted under 35 U.S.C. 154(b) by 435 days.

(21) Appl. No.: 14/047,901

(22) Filed: Oct. 7, 2013

(65) Prior Publication Data

US 2014/0328713 A1 Nov. 6, 2014

(30) Foreign Application Priority Data

May 5, 2013 (CN) ..... 2013 1 0160446

(51) Int. Cl.

| | |
|---|---|
| ***B22F 3/02*** | (2006.01) |
| ***B22F 3/10*** | (2006.01) |
| ***B22F 9/04*** | (2006.01) |
| ***B22F 9/08*** | (2006.01) |
| ***H01F 1/057*** | (2006.01) |

(52) U.S. Cl.

CPC ..... *B22F 9/08* (2013.01); *H01F 1/0577* (2013.01); *B22F 2998/10* (2013.01); *C22C 2202/02* (2013.01)

(58) Field of Classification Search

CPC ..... B22F 3/02; B22F 3/10; B22F 9/04; B22F 9/08; B22F 2998/10; C22C 2202/02; H01F 1/0577

USPC ..... 419/29; 420/416; 75/246; 252/62.55

See application file for complete search history.

(56) References Cited

U.S. PATENT DOCUMENTS

| | | | | |
|---|---|---|---|---|
| 4,851,058 | A | 7/1989 | Croat | |
| 5,383,978 | A | 1/1995 | Yamamoto et al. | |
| 5,405,455 | A * | 4/1995 | Kusunoki | H01F 1/0577 148/103 |
| 5,595,608 | A * | 1/1997 | Takebuchi | H01F 1/0577 148/103 |
| 5,645,651 | A | 7/1997 | Fujimura et al. | |
| 6,461,565 | B2 | 10/2002 | Tokuhara et al. | |
| 6,468,365 | B1 * | 10/2002 | Uchida | H01F 1/0577 148/302 |
| 6,491,765 | B2 | 12/2002 | Okayama et al. | |
| 6,527,874 | B2 | 3/2003 | Li | |
| 6,537,385 | B2 | 3/2003 | Okayama et al. | |
| 8,287,661 | B2 * | 10/2012 | Ishii | H01F 1/0577 148/302 |
| 8,961,712 | B2 * | 2/2015 | Hayakawa | B22F 3/10 148/302 |
| 2004/0189426 | A1 * | 9/2004 | Hidaka | H01F 1/0577 335/202 |
| 2007/0240788 | A1 * | 10/2007 | Nakamura | H01F 41/0293 148/101 |
| 2010/0026432 | A1 * | 2/2010 | Nagata | C22C 33/0242 419/27 |
| 2014/0327195 | A1 * | 11/2014 | Sun | C21D 9/0031 266/250 |
| 2014/0328711 | A1 * | 11/2014 | Sun | H01F 1/0577 419/20 |
| 2014/0328712 | A1 * | 11/2014 | Sun | H01F 41/0293 419/27 |
| 2015/0071810 | A1 * | 3/2015 | Lv | H01F 1/0577 419/23 |
| 2015/0243433 | A1 * | 8/2015 | Sun | B22F 9/04 148/102 |
| 2015/0248968 | A1 * | 9/2015 | Sun | H01F 1/0577 419/28 |

FOREIGN PATENT DOCUMENTS

| | | | |
|---|---|---|---|
| CN | 1182548 | | 12/2004 |
| CN | 1195600 | | 4/2005 |
| CN | 1272809 | | 8/2006 |
| WO | WO 2014/101247 | * | 7/2014 |

OTHER PUBLICATIONS

Abstract of CN 102610347; Jul. 2012; 3 pages.*

* cited by examiner

*Primary Examiner* — Helene Klemanski

(57) ABSTRACT

A double-alloy NdFeB rare earth permanent magnetic material and manufacturing method thereof are provided. The method comprises respectively melting an A1 alloy comprising heavy rare earth such as Dy, Tb, Ho and Gd as well as an A2 alloy comprising light rare earth such as La, Ce, Pr and Nd; mixing the A1 alloy and the A2 alloy by a two-dimensional or three-dimensional mixer with a ratio of A1/A2=0~0.5 under protection of nitrogen; producing powder in a jet mill after mixing; collecting fine powder; putting and mixing the powder and the fine powder in the two-dimensional or three-dimensional mixer; putting into a magnetic field pressing machine for pressing under the protection of the nitrogen after mixing and producing permanent magnetic products by sintering, aging, etc. The present invention can obviously decrease rare earth utilization and increase a magnetic energy product and coercivity of the rare earth permanent magnet.

10 Claims, No Drawings

DOUBLE-ALLOY NDFEB RARE EARTH PERMANENT MAGNETIC MATERIAL AND MANUFACTURING METHOD THEREOF

BACKGROUND OF THE PRESENT INVENTION

1. Field of Invention

The present invention relates to a field of permanent magnetic materials, and more particularly to a double-alloy NdFeB (neodymium-iron-boron) rare earth permanent magnetic material and a manufacturing method thereof.

2. Description of Related Arts

Because of the superior magnetic property, NdFeB rare earth permanent magnetic materials are widely applied on medical nuclear magnetic resonance imaging, hard disk drives, speakers, mobile phones, etc. And with the requirements of energy-saving and low-carbon economy, the NdFeB rare earth permanent magnetic materials are also applied on fields such as automobile parts, household appliances, energy-saving, control motors, hybrid cars and wind power generations.

In 1982, Japanese patents 1,622,492 and 2,137,496 about NdFeB rare earth permanent magnetic material were published by Japan Sumitomo Special Metals Co., Ltd. Then the company applied for United States patent and European patent. The patents disclosed the features, components and manufacture method of the NdFeB rare earth permanent magnetic material. The patents also disclosed the main phase: Nd2Fe14B phase, and the grain boundary phase: Nd-rich phase, B-rich phase and rare earth oxide impurities Almost at the same time, American GM Company applied for a very similar patent, U.S. Pat. No. 4,851,058. The difference of the two patents is the manufacturing method. The Japan Sumitomo Special Metals Co., Ltd. utilizes powder metallurgy technology, and the American GM Company utilizes melt spinning manufacturing method, wherein the method comprises producing powders at first, and then hot pressing the powder or mixing the powder with resin for producing magnet. The Japan Sumitomo Special Metals Co., Ltd. applied for patent U.S. Pat. No. 5,645,651 in July, 1995. Japan Santoku Metals Co., Ltd. obtained United States patent U.S. Pat. No. 5,383,978. The above are early patents of NdFeB.

Japan Hitachi Metals Co., Ltd. was incorporated with Japan Sumitomo Special Metals Co., Ltd. in Apr. 1, 2007 and the rights and duties of the NdFeB rare earth permanent magnetic material patent were inherited. When the Japan Hitachi Metals Co., Ltd. took legal action against the United States International Trade Commission (ITC), proprietary rights of the U.S. Pat. No. 6,461,565, U.S. Pat. No. 6,491,765, U.S. Pat. No. 6,537,385 and U.S. Pat. No. 6,527,874 were claimed.

Patent U.S. Pat. No. 6,461,565, filed May 8, 2011, whose Chinese application number is CN 1195600C, claims that magnetic compaction cannot be provided in protective gas, and applied for the protection of magnetic field generation under atmospheric conditions, wherein a working temperature is higher than 5° C. and lower than 30° C., a relative humidity is between 40% and 65%. Powder pressing is provided under the conditions. A sintering process appears after the pressing.

The scopes of the patent U.S. Pat. No. 6,491,765, filed May. 9, 2011 and the patent U.S. Pat. No. 6,537,385, filed Jul. 9, 2001 are almost the same. And the two patents applied for a same Chinese application CN 1272809C. The patent divides the powder production into two steps: the first step provides coarsely pulverization to alloy slices by hydrogen pulverization method; the second step provides finely pulverization by an inactive gas jet mill with oxygen content of 0.02~5%. The products are collected by cyclone collector in such a manner that at least a part of the fine powder with a diameter less than 1 μm is removed and the content thereof is under 10% of the amount of the powder. In fact, all jet mills utilize cyclone collectors and emission of a part of the particles with a diameter less than 1 μm with the air flow is inevitable.

The patent U.S. Pat. No. 6,527,874 of the Japan Hitachi Metals Co., Ltd., filed Jul. 10, 2001, and the Chinese patent CN 1182548C claimed a strip casting technology in a smelting procedure of NdFeB rare earth permanent magnetic alloys made of metals selected from the group consisting of Nb and Mo. The Japan Sumitomo Special Metals Co., Ltd. invented the technology of producing sintering magnetic alloy by strip casting, which was authorized as patent JP 4,028,656, and patent U.S. Pat. No. 5,383,978 in January, 1995 in America. Then the technology was authorized as European patents EP 0,556,751B1 and EP 0,632,471B1.

SUMMARY OF THE PRESENT INVENTION

With expansion of an application market of NdFeB rare earth permanent magnetic materials, shortage of rare earth resources is getting more and more serious. Especially, in fields of automobile parts, hybrid cars and wind power generation, more the rare earth such as Dy and Tb is needed for improving coercivity. Therefore, how to reduce utilization of the rare earth, especially of the heavy rare earth, is an important topic in front of us. In the past, a method for improving magnetic property by utilizing double-alloy was noticed. However, a ratio of a main phase, R2Fe14B is increased. And one alloy is melted according to rare earth with a rare earth content a little lower than the R2Fe14B, the other alloy is melted according to a rare-earth-rich alloy with a high rare earth content. The two alloys are mixed with a certain ratio before producing powder for improving the magnetic property. An object of the method is increasing the ratio of the main phase, R2Fe14B, for decreasing separation of α-Fe. That is to say, the ratio of the main phase is increased for improving the magnetic property. With thorough researches and many experiments, the magnetic property of a permanent magnet can be improved by respectively melting an A1 alloy comprising Dy, Tb, Ho and Gd, and an A2 alloy comprising La, Ce, Pr and Nd, then providing coarsely pulverization, powder production, magnetic compaction and sintering. At the same time, the utilization of the heavy rare earth is obviously decreased. When compared to the conventional technology, the present invention has obvious improvement.

Accordingly, in order to accomplish the above objects, the present invention provides a double-alloy NdFeB rare earth permanent magnetic material and a manufacturing method thereof;

wherein a molecular formula of the A1 alloy is: $R1_x(Fe_{1-n}Co_n)_{100-x-y-z}B_yM_z$;

wherein a molecular formula of the A2 alloy is: $R2_x(Fe_{1-n}Co_n)_{100-x-y-z}B_yM_z$;

wherein the x, y, z and n refer to mass percents of elements and ranges thereof are as follows:

x=29%~31%;

y=0.9%~1.1%;

z=0.1%~8%;

wherein R1 is at least one heavy rare earth element selected from the group consisting of Dy, Tb, Ho and Gd;

R2 is at least one light rare earth element selected from the group consisting of Pr and Nd;

B is a B element;

M is at least one element selected from the group consisting of Al, Ga, Zr and Cu;

n is a content of Co, a range thereof is: n=0~0.2;

a rest content is Fe;

wherein A1/A2=0~0.5.

The method comprises steps of:

1. Producing Alloy Slices:

wherein the step 1 specifically comprises mixing the A1 alloy and the A2 alloy according to the ratio, melting under vacuum or protection gas, wherein a melting temperature is controlled at 1300~1400° C., tilting a crucible after melting and keeping the temperature for casting melted alloy liquid to a copper rotating roller with water cooling through a bakie, cooling to 450~580° C. with a cooling speed of 100~1000° C./s for forming alloy slices, leading the alloy slices to a rotating plate under the copper rotating roller and keeping the temperature, mechanically stirring the alloy slices after keeping the temperature for 10~120 min, cooling to lower than 80° C. by argon at the same time before respectively putting into a storage tank; wherein the A1 alloy is preferably cooled to 510~580° C. with the cooling speed of 100~300° C./s, and the A2 alloy is preferably cooled to 510~580° C. with the cooling speed of 600~1000° C./s; wherein the step 1 can also be embodied as respectively providing the vacuum induction melting to the A1 alloy and the A2 alloy, casting the melted alloy liquid to the copper rotating roller with water cooling through the bakie for forming the alloy slices, then leading the alloy slices to a rotating barrel by a leading board, wherein a screw leading board is provided on an inner wall of the rotating barrel, and the alloy slices rotates in the rotating barrel, reversing the rotating barrel after the temperature of the alloy slices is kept or the alloy slices are cooled in the rotating barrel in such a manner that the alloy slices drop to a collection tank under the rotating barrel, wherein the collection tank is connected to a vacuum furnace body by a valve, an inner barrel is provided in an inner space of said collection tank, said inner barrel is cooled by cooling water, said alloy slices drop into a gap between said inner barrel and said inner wall, an external wall and a center of said collection tank is cooled by said cooling water in such a manner that said alloy slices are indirectly cooled; capping the collection tank under vacuum or protective atmosphere conditions and closing the valve after the alloy slices are all leaded to the collection tank, then removing the collection tank, wherein an external wall and a center of the rotating barrel is cooled by the cooling water in such a manner that the alloy slices are indirectly cooled;

wherein the step 1 can also be embodied as respectively providing the vacuum induction melting to the A1 alloy and the A2 alloy, casting the melted alloy liquid to a portable mould with water cooling through the bakie for cooling, wherein a thickness of cast ingots is 1~20 mm;

wherein the step 1 can also be embodied as providing the vacuum induction melting to the A1 alloy, casting the melted alloy liquid to the portable mould with water cooling through the bakie for cooling, wherein the thickness of the cast ingots is less than 15 mm; then providing vacuum induction melting to the A2 alloy, casting the melted alloy liquid to the copper rotating roller with water cooling through the bakie for forming the alloy slices, mechanically stirring the alloy slices after the alloy slices drop to the rotating plate under the copper rotating roller, circularly cooling by the argon at the same time before respectively putting into the storage tank, wherein after the alloy slices drop to the rotating plate under the copper rotating roller, the temperature can be kept before mechanically stirring the alloy slices and circularly cooling by the argon at the same time before respectively putting into the storage tank;

2. Providing Coarsely Pulverization and Producing the Powder:

(1) providing coarsely pulverization: wherein the step (1) specifically comprises respectively putting the alloy slices of the A1 alloy and the A2 alloy into a basket of a vacuum hydrogen pulverization furnace, and providing hydrogen adsorption in the vacuum hydrogen pulverization, wherein a hydrogen adsorption temperature is 10~200° C., and preferably 100~200° C.; evacuating the hydrogen pulverization furnace to $5\times10^{-1}$ Pa, closing a vacuum valve, detecting a pressure rise rate, then inflating with nitrogen to over 30 KPa if the pressure rise rate is qualified, closing the vacuum valve and keeping the pressure for over 10 min, and detecting the pressure rise rate again, then evacuating again to $5\times10^{-1}$ pa if the pressure rise rate is qualified, closing the vacuum valve and inflating with hydrogen to 20~200 KPa, preferably 50~80 KPa, keeping the pressure for 10~60 min for finishing the hydrogen adsorption; evacuating again to 100 Pa and heating to 600~900° C., keeping the temperature for 2 h, stopping keeping the temperature if the pressure is 5 Pa or 2 h has passed for finishing dehydrogenation; closing the vacuum valve, cooling after inflating with the argon, putting the alloy slices into a separatory tank under vacuum or protective gas after the temperature is lower than 80° C., wherein the hydrogen adsorption, the dehydrogenation and the cooling can be provided in one vacuum room or a plurality of vacuum rooms with valves provided therebetween; a copper oblate tube is provided on the basket of the vacuum hydrogen pulverization furnace, a hole is drilled on a bottom of the copper oblate tube; when providing the hydrogen adsorption, the hydrogen uniformly diffuses to grain boundaries of the alloy slices through the hole on the copper oblate tube; at the same time, the copper oblate tube is also conducive to the dehydrogenation and the cooling;

(2) mixing: wherein the step (2) specifically comprises putting and mixing the A1 alloy powder and the A2 alloy powder stored in the respective tanks in a two-dimensional mixer with the ratio of A1/A2=0~0.5 under the protection of the nitrogen, wherein a mixing time is over 30 min, storing the mixture in the separatory tank with the protection of the nitrogen after mixing; and (3) producing the powder in a jet mill, wherein the step (3) specifically comprises connecting the separatory tank with the materials to the jet mill with the protection of the nitrogen by a valve, leading the materials to a loading tank of the jet mill, uniformly feeding the materials to a mill room of the jet mill by a belt conveyor, wherein the mill room is connected to the belt conveyor by a flexible tube; wherein a electronic balance is provided in the mill room, a weight of the materials in the mill room is controlled by adjusting a speed of the belt conveyor; wherein multi-direction opposite spray nozzles are provided on a bottom of the mill room, and three the multi-direction opposite spray nozzles are provided on a horizontal circumference with separation angles of 120 degrees; wherein a sizing wheel is provided on a top of the mill room, a diameter of the powder is controlled by adjusting a speed of the sizing wheel; wherein the milled powder rises with air flow, and when touching the sizing wheel, the powder with large diameter is sent back to the mill room by a centrifugal force for further milling, the qualified powder passes through blades of the sizing wheel into a cyclone collector and is stored in a powder storage tank under the cyclone collector; wherein fine powder with the diameter less than 1 μm is emitted with the air flow, the emitted fine powder is collected by a fine powder collector behind the cyclone collector; 5~15% of the fine powder can be collected by the fine powder collector and the collected fine powder has a high rare earth content, therefore, the collected fine powder can be added to the powder collected by the cyclone collector as a rare earth phase; wherein for preserving the fine powder from oxidation, a oxygen content of the jet mill must be lower than 200 ppm, preferably lower than 50 ppm, and a temperature of the mill room should be lower than 50° C., preferably 5~20° C.; therefore, a cooler is provided between a nitrogen compressor and the spray nozzles, and an exhaust temperature of the cooler is lower than 20° C.; wherein large particles has an important impact on the magnetic property of the magnet, and decreasing the large particles is difficult for the jet mill; however, research and experiment results show that adding an air jet device between the spray nozzles and the sizing wheel can decrease the particles in the powder and improve size distribution as well as the magnetic property;

3. Forming:

wherein the magnet powder in the separatory tank is easy to be oxidized and burned because of a high oxygen content; when forming NdFeB magnet by a conventional press machine, the oxygen content will be increased and the magnetic property will be lowered; therefore, a novel magnetic field forming technology is developed according to the present invention;

wherein the step 3 specifically comprises putting the magnet powder into a nitrogen protection tank of a magnetic field press machine under the protection of the nitrogen, or directly connecting the separatory tank to the protection tank by a valve, then quantifying according to a magnet weight requirement and putting into a forming room of the nitrogen protection tank; putting a forming mould in an alignment magnetic field according a magnet requirement, wherein an intensity of the alignment magnetic field in the forming room is higher than 1.5~3 T; aligning before pressing the magnet powder and keeping the intensity of the alignment magnetic field during pressing; wherein the alignment magnetic field can be a constant magnetic field, a pulsating magnetic field or a alternating magnetic field; packaging the magnet after pressing, then taking out of the protection tank and putting into an isostatic press machine for providing isostatic pressing; wherein a glove and an observing window are provided on the protection tank; further providing the isostatic pressing after pressing for decreasing micro cracks and improving the magnetic property; wherein some products do not need isostatic pressing, and can be transported to a sintering furnace from the protection tank directly or under the protective gas; wherein a purity of the nitrogen in the protective tank is high than 99.98%, a temperature of the alignment magnetic field space is low than 5° C., when the purity of the nitrogen is lower than 99.98%, the oxygen content of the magnet will be increased; when the temperature is higher than 5° C., the magnetic property will be lowered and the rare earth utilized will be increased; and 4. Sintering:

wherein the step 4 specifically comprises removing an external pack of the magnet after isostatic pressing, putting the magnet with an internal pack to a protection box connected to a vacuum sintering furnace; wherein usually, a glove is provided on the protecting box, and a transporter is provided therein; putting the magnet in a material box made of graphite, a cap is provided on the material box; sending the material box with the magnet in to a heating room by the transporter for heating, wherein a sintering temperature is controlled at 1000~1150° C., a vacuity is high than $5\times10^{-1}$ Pa, providing split aging after sintering; wherein a temperature of high-temperature aging is 800~950° C., a temperature of low-temperature aging is 500~650° C.; rapidly cooling by inactive gas;

respectively producing the powder from the A1 alloy and the A2 alloy by the jet mill after providing the coarsely pulverization, collecting the powder by the cyclone collector behind the jet mill, collecting the fine powder by the fine powder collector behind the cyclone collector, then mixing the powder collected by the cyclone collector and the fine powder collected by the fine powder collector, putting and mixing the in a two-dimensional or three-dimensional mixer with a mixing time over 30 min under the protection of the nitrogen, and storing the mixture in the separatory tank with the protection of the nitrogen after mixing; wherein an average diameter of the A1 alloy is 1~3 μm, an average diameter of the A2 alloy is 3~5 μm; mixing the A1 alloy and the A2 alloy stored in respective tanks by the two-dimensional or three-dimensional mixer with the ratio of A1/A2=0~0.5 under the protection of the nitrogen, wherein the oxygen content of the gas is controlled under 50 ppm; wherein forming and sintering can be provided directly after mixing.

The present invention respectively melts the A1 alloy comprising heavy rare earth such as Dy, Tb, Ho and Gd as well as the A2 alloy comprising light rare earth such as La, Ce, Pr and Nd. The rare earth utilized is obviously decreased. At the same time, the present invention adapts to producing rare earth permanent magnetic products with high magnetic property because the magnetic property and the coercivity of the magnet are improved and scarce resources are protected.

These and other objectives, features, and advantages of the present invention will become apparent from the following detailed description, the accompanying drawings, and the appended claims.

DETAILED DESCRIPTION OF THE PREFERRED EMBODIMENT

According to preferred embodiments, the present invention is illustrated.

Preferred Embodiment 1

Taking:

A1 alloy: Dy30Fe67.5Co1.2Cu0.2B 0.9Al0.2 and

A2: (Pr0.2Nd0.8)30Fe67.5Co1.2Cu0.2B0.9Al0.2 for experiment and a method thereof is as follows:

(1) respectively providing vacuum induction melting to the A1 alloy and the A2 alloy, casting melted alloy liquid to a copper rotating roller with water cooling through a bakie for forming alloy slices, then leading the alloy slices to the rotating plate under the copper rotating roller, mechanically stirring the alloy slices after keeping a temperature for 10 min, and cooling by the argon at the same time, respectively storing in a storage tank after being cooled to lower than 80° C.;

(2) respectively providing coarsely pulverization to the A1 alloy and the A2 alloy by a vacuum hydrogen pulverization furnace, respectively mixing by a two-dimensional mixer with ratios of A1/A2=0/30, 3/27, 6/24 and 10/20 under protection of nitrogen, producing powder in a jet mill after mixing, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Preferred Embodiment 2

Taking:

A1 alloy: Dy30Fe67.5Co1.2Cu0.2B 0.9Al0.2 and

A2: (Pr0.2Nd0.8)30Fe67.5Co1.2Cu0.2B0.9Al0.2 for experiment and a method thereof is as follows:

(1) respectively providing vacuum induction melting to the A1 alloy and the A2 alloy, casting melted alloy liquid to a copper rotating roller with water cooling through a bakie for forming alloy slices, then leading the alloy slices to the rotating plate under the copper rotating roller, mechanically stirring the alloy slices, and cooling by the argon at the same time, respectively storing in a storage tank after being cooled to lower than 80° C.;

(2) respectively providing coarsely pulverization to the A1 alloy and the A2 alloy by a vacuum hydrogen pulverization furnace, respectively mixing by a two-dimensional mixer with a ratio of A1/A2=3/27 under protection of nitrogen, producing powder in a jet mill after mixing, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Comparison Example 1

Taking:

alloy: Dy3(Pr0.2Nd0.8)27Fe66.5Co1.2Cu0.2B0.9Al0.2 for experiment and a method thereof is as follows:

(1) providing vacuum induction melting to the alloy, casting melted alloy liquid to a copper rotating roller with water cooling through a bakie for forming alloy slices, then leading the alloy slices to the rotating plate under the copper rotating roller, mechanically stirring the alloy slices, and cooling by the argon at the same time, respectively storing in a storage tank after being cooled to lower than 80° C.;

(2) providing coarsely pulverization to the alloy by a vacuum hydrogen pulverization furnace, producing powder in a jet mill, wherein an oxygen content of gas is controlled under 50 ppm during powder producing; collecting the powder by a cyclone collect and collecting fine powder with a diameter less than 1 μm by a fine powder collector, mixing in the two-dimensional mixer under protection of nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Preferred Embodiment 3

Taking:

A1: Dy30Fe67.5Co1.2Cu0.2B 0.9Al0.2 and

A2: (Pr0.2Nd0.8)30Fe67.5Co1.2Cu0.2B0.9Al0.2 for experiment and a method thereof is as follows:

(1) respectively providing vacuum induction melting to the A1 alloy and the A2 alloy, casting melted alloy liquid to a portable mould with water cooling through a bakie for cooling, wherein a thickness of cast ingots is 10 mm, respectively storing in a storage tank after being cooled to lower than 80° C.;

(2) respectively providing coarsely pulverization to the A1 alloy and the A2 alloy by a vacuum hydrogen pulverization furnace, respectively mixing by a two-dimensional mixer with a ratio of A1/A2=6/24 under protection of nitrogen, producing powder in a jet mill after mixing, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Comparison Example 2

Taking:

alloy: Dy6(Pr0.2Nd0.8)24Fe66.5Co1.2Cu0.2B0.9Al0.2 for experiment and a method thereof is as follows:

(1) providing the vacuum induction melting to the alloy, casting the melted alloy liquid to a portable mould with water cooling through the bakie for cooling, wherein a thickness of cast ingots is 10 mm, respectively storing in a storage tank after being cooled to lower than 80° C.;

(2) providing coarsely pulverization to the alloy by a vacuum hydrogen pulverization furnace, producing powder in a jet mill, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Preferred Embodiment 4

Taking:

A1: Dy30Fe67.5Co1.2Cu0.2B 0.9Al0.2 and

A2: (Pr0.2Nd0.8)30Fe67.5Co1.2Cu0.2B0.9Al0.2 for experiment and a method thereof is as follows:

(1) providing vacuum induction melting to the A1 alloy, casting melted alloy liquid to a portable mould with water cooling through a bakie for cooling, wherein a thickness of cast ingots is less than 12 mm; then providing vacuum induction melting to the A2 alloy, casting the melted alloy liquid to a copper rotating roller with water cooling through the bakie for forming alloy slices, mechanically stirring the alloy slices after the alloy slices drop to a rotating plate under the copper rotating roller, circularly cooling by argon at the same time before respectively putting into a storage tank;

(2) respectively providing coarsely pulverization to the A1 alloy and the A2 alloy by a vacuum hydrogen pulverization furnace, respectively mixing by a two-dimensional mixer with a ratio of A1/A2=10/20 under protection of nitrogen, producing powder in a jet mill after mixing, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

Comparison Example 3

Taking:

alloy: Dy10(Pr0.2Nd0.8)20Fe66.5Co1.2Cu0.2B0.9Al0.2 for experiment and a method thereof is as follows:

(1) providing vacuum induction melting to the alloy, casting melted alloy liquid to a portable mould with water cooling through a bakie for cooling, wherein a thickness of cast ingots is 12 mm, respectively storing in a storage tank after being cooled to lower than 80° C.;

(2) providing coarsely pulverization to the alloy by a vacuum hydrogen pulverization furnace, producing powder in a jet mill, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min.

TABLE 1 the contents of the rare earth and the magnetic property of the magnets in the preferred embodiments and comparison examples:

| Number | A1/A2 | Components of rare earth | Content of rare earth (%) | Remanence (Gs) | Coercivity (Oe) |
|---|---|---|---|---|---|
| 1 | Preferred embodiment 1 | (Pr0.2Nd0.8)30 | 30 | 14572 | 12846 |
| 2 | Preferred embodiment 2 | Dy3(Pr0.2Nd0.8)27 | 30 | 13802 | 18051 |
| 3 | Comparison example 1 | Dy3(Pr0.2Nd0.8)27 | 30 | 13930 | 19241 |
| 4 | Preferred embodiment 3 | Dy6(Pr0.2Nd0.8)24 | 30 | 12270 | 26500 |
| 5 | Comparison example 2 | Dy6(Pr0.2Nd0.8)24 | 30 | 12390 | 28800 |
| 6 | Preferred embodiment 4 | Dy10(Pr0.2Nd0.8)20 | 30 | 11410 | 29300 |
| 7 | Comparison example 3 | Dy10(Pr0.2Nd0.8)20 | 30 | 11540 | 30900 |

Preferred Embodiment 5

Taking:

A1: Dy31Fe66.4Co1.2Cu0.2B 0.9Al0.2Ga0.1 and

A2: (Pr0.25Nd0.75) 31Fe66.4Co1.2Cu0.2B0.9Al0.2Ga0.1 for experiment and a method thereof is as follows:

(1) respectively providing vacuum induction melting to the A1 alloy and the A2 alloy, casting melted alloy liquid to a copper rotating roller with water cooling through a bakie for forming alloy slices, then leading the alloy slices to the rotating plate under the copper rotating roller, mechanically stirring the alloy slices after keeping a temperature for 30 min, and cooling by the argon at the same time, respectively storing in a storage tank after being cooled to lower than 80° C.;

(2) respectively providing coarsely pulverization to the A1 alloy and the A2 alloy by a vacuum hydrogen pulverization furnace, respectively mixing by a two-dimensional mixer with ratios of A1/A2=3/28 under protection of nitrogen, producing powder in a jet mill after mixing, wherein an oxygen content of gas is controlled under 50 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.99%, an intensity of an alignment magnetic field is 1.8 T, a temperature of the alignment magnetic field space is 0° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min, wherein results are listed in a table 2.

Preferred Embodiment 6

Taking:

A1: (Dy0.6Tb0.4)31Fe66.3Co1.2Cu0.2B 0.9Al0.2Ga0.1Zr0.1 and

A2: Nd31Fe66.3Co1.2Cu0.2B0.9Al0.2Ga0.1Zr0.1 for experiment, wherein a method is the same as the method in the preferred embodiment 2 except for that the temperature is kept for 50 min instead of 30 min, and results are listed in the table 2.

Preferred Embodiment 7

Taking:

A1: (Gd0.3Ho0.3Dy0.4)31Fe66.3Co1.2Cu0.2B 0.9Al0.3Ga0.1 and

A2: Nd31Fe66.3Co1.2Cu0.2B0.9Al0.3Ga0.1 for experiment, wherein a method is the same as the method in the preferred embodiment 2 except for that the temperature of the alignment magnetic field space is −15° C. instead of 0° C., and results are listed in the table 2.

Preferred Embodiment 8

Taking:

A1: Dy29Fe66Co3.2Cu0.2B 1.1Al0.3Ga0.2 and

A2: (Pr0.25Nd0.75)29Fe66Co3.2Cu0.2B1.1Al0.3Ga0.2 for experiment and a method thereof is as follows:

(1) respectively providing vacuum induction melting to the A1 alloy and the A2 alloy, casting melted alloy liquid to the copper rotating roller with water cooling through the bakie for forming the alloy slices, then leading the alloy slices to a rotating barrel by a leading board, wherein a screw leading board is provided on an inner wall of the rotating barrel, a collection tank is connected to a vacuum furnace body by a valve; capping the collection tank under vacuum or protective atmosphere conditions and closing the valve after the alloy slices are all leaded to the collection tank, then removing the collection tank, an external wall and a center of said collection tank is cooled by said cooling water in such a manner that said alloy slices are indirectly cooled;

(2) respectively providing coarsely pulverization to the A1 alloy and the A2 alloy by a vacuum hydrogen pulverization furnace, respectively mixing by a two-dimensional mixer with ratios of A1/A2=6/23 under protection of nitrogen, producing powder in a jet mill after mixing, wherein an oxygen content of gas is controlled under 10 ppm during powder producing; collecting the powder by a cyclone collect and collecting fine powder with a diameter less than 1 μm by a fine powder collector, putting and mixing in the two-dimensional mixer under the protection of the nitrogen; and (3) providing magnetic compaction under the protection of the nitrogen, wherein a purity of the nitrogen in a protection box is higher than 99.999%, an intensity of an alignment magnetic field is 1.8 T, a temperature of the alignment magnetic field space is −3° C., packaging magnetic blocks after pressing, then taking the magnetic blocks out of the protection box and isopressing in a cold isostatic press machine, then putting into the vacuum sintering furnace for split sintering and aging while being isolated from atmosphere, wherein a sintering temperature is kept at 1060° C. for 2 h; a first sintering temperature is kept at 900° C. for 60 min, a second sintering temperature is kept at 600° C. for 90 min, wherein results are listed in the table 2.

Preferred Embodiment 9

Taking:

A1: Dy29Fe66Co3.2Cu0.2B 1.1Al0.3Ga0.2 and

A2: (Pr0.25Nd0.75)29Fe66Co3.2Cu0.2B1.1Al0.3Ga0.2 for experiment and a method thereof is as follows:

(1) respectively providing the vacuum induction melting to the A1 alloy and the A2 alloy, casting the melted alloy liquid to the copper rotating roller with water cooling through the bakie for forming the alloy slices, then leading the alloy slices to the rotating barrel by the leading board, wherein a screw leading board is provided on an inner wall of the rotating barrel, and the alloy slices rotates in the rotating barrel, reversing the rotating barrel in such a manner that the alloy slices drop to a collection tank under the rotating barrel, wherein a collection tank is connected to a vacuum furnace body by a valve; capping the collection tank under vacuum or protective atmosphere conditions and closing the valve after the alloy slices are all leaded to the collection tank, then removing the collection tank, an external wall and a center of said collection tank is cooled by said cooling water in such a manner that said alloy slices are indirectly cooled, wherein other parts of the method is the same as the method in the preferred embodiment 5.

Preferred Embodiment 10

Taking:

A1: Dy29Fe66Co3.4Cu0.2B 1.1Al0.3 and

A2: (Pr0.25Nd0.75)29Fe66Co3.4Cu0.2B1.1Al0.3 for experiment, wherein a method is the same as the method in the preferred embodiment 5 except for that the temperature is kept for 70 min instead of 10 min.

Preferred Embodiment 11

Taking:

A1: Dy29Fe64Co5.4Cu0.2B 1.1Al0.3 and

A2: (Pr0.2Nd0.8)29Fe64Co5.4Cu0.2B1.1Al0.3 for experiment, wherein a method is the same as the method in the preferred embodiment 5 except for that the temperature is kept for 120 min instead of 10 min.

TABLE 2 the contents of the rare earth and the magnetic property of the magnets in the preferred embodiments:

| Number | A1/A2 | Components of rare earth | Content of rare earth (%) | Remanence (Gs) | Coercivity (Oe) |
|---|---|---|---|---|---|
| 1 | Preferred embodiment 5 | Dy3 (Pr0.25Nd0.75)28 | 31 | 13882 | 18906 |
| 2 | Preferred embodiment 6 | (Dy0.6Tb0.4)3Nd28 | 31 | 13977 | 21100 |
| 3 | Preferred embodiment 7 | (Gd0.3Ho0.3Dy0.4)3Nd28 | 31 | 13733 | 17056 |
| 4 | Preferred embodiment 8 | Dy6(Pr0.25Nd0.75)23 | 29 | 12520 | 28400 |
| 5 | Preferred embodiment 9 | Dy6(Pr0.25Nd0.75)23 | 29 | 12470 | 28300 |
| 6 | Preferred embodiment 10 | Dy6(Pr0.2Nd0.8)23 | 29 | 12580 | 28600 |
| 7 | Preferred embodiment 11 | Dy6(Pr0.2Nd0.8)23 | 29 | 12650 | 28500 |

According to the above preferred embodiments and comparison examples, the present invention respectively melts the A1 alloy comprising heavy rare earth such as Dy, Tb, Ho and Gd as well as the A2 alloy comprising light rare earth such as La, Ce, Pr and Nd. The rare earth utilized is obviously decreased. At the same time, the present invention adapts to producing rare earth permanent magnetic products with high magnetic property because the magnetic property and the coercivity of the magnet are improved and scarce resources are protected.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A manufacturing method of a double-alloy NdFeB rare earth permanent magnetic material, wherein the double-alloy NdFeB rare earth permanent magnetic material is produced by mixing an A1 alloy and an A2 alloy with a ratio of A1/A2 which is larger than 0 and no more than 0.5:

wherein a molecular formula of said A1 alloy is: $R1_x(Fe_{1-n}Co_n)_{100-x-y-z}B_yM_z$;

wherein a molecular formula of said A2 alloy is: $R2_x(Fe_{1-n}Co_n)_{100-x-y-z}B_yM_z$;

wherein said x, y, z and n refer to mass percents of elements and ranges thereof are as follows:

x=29%~31%;

y=0.9%~1.1%;

z=0.1%~8%;

wherein R1 is at least one heavy rare earth element selected from the group consisting of Dy, Tb, Ho and Gd;

R2 is at least one light rare earth element selected from the group consisting of Pr and Nd;

B is a B element;

M is at least one element selected from the group consisting of Al, Ga, Zr and Cu;

n is a content of Co, a range thereof is: n=0~0.2;

and the balance Fe;

wherein the manufacturing method comprises steps of:

(1) respectively providing vacuum induction melting to the A1 alloy and the A2 alloy, casting melted alloy liquid to a copper rotating roller with water cooling through a bakie for forming alloy slices, mechanically stirring the alloy slices after the alloy slices drop to a rotating plate under the copper rotating roller, circularly cooling by argon at the same time before respectively putting into a storage tank;

(2) respectively providing pulverization to the A1 alloy and the A2 alloy by a vacuum hydrogen pulverization furnace, mixing by a two-dimensional or three-dimensional mixer with the ratio of A1/A2 which is larger than 0 and no more than 0.5 under protection of nitrogen, producing powder in a jet mill after mixing, collecting the powder by a cyclone collector, and collecting fine powder emitted from the cyclone collector with air flow by a fine powder collector, mixing the powder collected by the cyclone collector and the fine powder collected by the fine powder collector after stopping the jet mill, wherein an oxygen content of gas is controlled under 50 ppm during powder producing, an average diameter of the A1 alloy is 1~3 μm, an average diameter of the A2 alloy is 3~5 μm; and (3) providing magnetic compaction under the protection of the nitrogen, wherein a purity of the nitrogen in a protection box is higher than 99.98%, a temperature of an alignment magnetic field space is lower than 5° C., packaging magnetic blocks after pressing, then taking the magnetic blocks out of the protection box and putting into a vacuum sintering furnace for sintering and aging while being isolated from atmosphere.

2. The manufacturing method, as recited in claim 1, comprising respectively providing the vacuum induction melting to the A1 alloy and the A2 alloy, casting the melted alloy liquid to the copper rotating roller with water cooling through the bakie for forming the alloy slices, then leading the alloy slices to the rotating plate under the copper rotating roller, mechanically stirring the alloy slices after keeping a temperature, and cooling by the argon at the same time.

3. The manufacturing method, as recited in claim 1, wherein the step (1) is: respectively providing the vacuum induction melting to the A1 alloy and the A2 alloy, casting the melted alloy liquid to the copper rotating roller with water cooling through the bakie for forming the alloy slices, then leading the alloy slices to a rotating barrel by a leading board, wherein a screw leading board is provided on an inner wall of the rotating barrel, and the alloy slices rotates in the rotating barrel, reversing the rotating barrel in such a manner that the alloy slices drop to a collection tank under the rotating barrel, wherein the collection tank is connected to a vacuum furnace body by a valve; capping the collection tank under vacuum or protective atmosphere conditions and closing the valve after the alloy slices are all leaded to the collection tank, then removing the collection tank.

4. The manufacturing method, as recited in claim 1, wherein an inner barrel is provided in an inner space of a collection tank, said inner barrel is cooled by cooling water, said alloy slices drop into a gap between said inner barrel and an inner wall, an external wall and a center of said collection tank is cooled by said cooling water in such a manner that said alloy slices are indirectly cooled.

5. The manufacturing method, as recited in claim 3, wherein an inner barrel is provided in an inner space of said collection tank, said inner barrel is cooled by cooling water, said alloy slices drop into a gap between said inner barrel and said inner wall, an external wall and a center of said collection tank is cooled by said cooling water in such a manner that said alloy slices are indirectly cooled.

6. The manufacturing method, as recited in claim 1, wherein the step (3) is: taking the magnetic blocks out of the protection box, isopressing in a cold isostatic press machine before putting into the vacuum sintering furnace for sintering.

7. The manufacturing method, as recited in claim 1, wherein the step (1) is: respectively providing the vacuum induction melting to the A1 alloy and the A2 alloy, casting the melted alloy liquid to a portable mould with water cooling through the bakie for cooling, wherein a thickness of cast ingots is less than 15 mm.

8. The manufacturing method, as recited in claim 1, wherein the step (1) is: providing the vacuum induction melting to the A1 alloy, casting the melted alloy liquid to a portable mould with water cooling through the bakie for cooling, wherein a thickness of cast ingots is less than 15 mm; then providing vacuum induction melting to the A2 alloy, casting the melted alloy liquid to the copper rotating roller with water cooling through the bakie for forming the alloy slices, mechanically stirring the alloy slices after the alloy slices drop to the rotating plate under the copper rotating roller, circularly cooling by the argon at the same time before respectively putting into the storage tank.

9. The manufacturing method, as recited in claim 1, wherein the step (1) is: providing the vacuum induction melting to the A1 alloy, casting the melted alloy liquid to a portable mould with water cooling through the bakie for cooling, wherein a thickness of cast ingots is less than 15 mm; then providing vacuum induction melting to the A2 alloy, casting the melted alloy liquid to the copper rotating roller with water cooling through the bakie for forming the alloy slices, mechanically stirring the alloy slices after the alloy slices drop to the rotating plate under the copper rotating roller after keeping a temperature, circularly cooling by the argon at the same time before respectively putting into the storage tank.

10. The manufacturing method, as recited in claim 8, wherein the step (1) is: providing the vacuum induction melting to the A1 alloy, casting the melted alloy liquid to the portable mould with water cooling through the bakie for cooling, wherein the thickness of the cast ingots is less than 15 mm; then providing vacuum induction melting to the A2 alloy, casting the melted alloy liquid to the copper rotating roller with water cooling through the bakie for forming the alloy slices, mechanically stirring the alloy slices after the alloy slices drop to the rotating plate under the copper rotating roller after keeping a temperature, circularly cooling by the argon at the same time before respectively putting into the storage tank.

* * * * *